US006761942B2

(12) United States Patent
Katoh et al.

(10) Patent No.: US 6,761,942 B2
(45) Date of Patent: Jul. 13, 2004

(54) INK JET RECORDING SHEET

(75) Inventors: Eisaku Katoh, Hino (JP); Yoshinori Tsubaki, Hino (JP); Masayuki Ushiku, Hino (JP); Keiji Ohbayashi, Hino (JP)

(73) Assignee: Konica Corporation (JP)

( * ) Notice: Subject to any disclaimer, the term of this patent is extended or adjusted under 35 U.S.C. 154(b) by 51 days.

(21) Appl. No.: 10/015,978

(22) Filed: Dec. 10, 2001

(65) Prior Publication Data

US 2002/0130943 A1 Sep. 19, 2002

(30) Foreign Application Priority Data

Dec. 25, 2000 (JP) ..... 2000/392501

(51) Int. Cl.[7] ..... B41M 5/40

(52) U.S. Cl. ..... 428/32.31; 428/32.24; 428/32.26; 428/32.28; 428/32.29

(58) Field of Search ..... 428/32.24, 32.26, 428/32.28, 32.29, 32.31, 195, 212, 328, 500, 514, 522

(56) References Cited

U.S. PATENT DOCUMENTS 4,554,181 A 11/1985 Cousin et al. ..... 427/261
6,093,529 A * 7/2000 Tsuzuki et al. ..... 430/619
6,096,469 A * 8/2000 Anderson et al. ..... 430/119
6,110,601 A * 8/2000 Shaw-Klein et al. ..... 428/522
6,326,323 B1 * 12/2001 Shimano et al. ..... 442/76
6,338,891 B1 * 1/2002 Kawasaki et al. ..... 428/195
6,521,323 B1 * 2/2003 Sakaki et al. ..... 428/195

FOREIGN PATENT DOCUMENTS

EP 199874 11/1985
EP 754560 1/1997
EP 818322 1/1998
EP 1 034 940 A1 * 9/2000

OTHER PUBLICATIONS

European Search Report EP 01 12 9628.

* cited by examiner

*Primary Examiner*—B. Shewareged
(74) *Attorney, Agent, or Firm*—Muserlian, Lucas and Mercanti

(57) ABSTRACT

An ink jet recording sheet comprising a non-water absorptive support having thereon an ink absorptive layer comprising polyvinyl alcohol, a cationic polymer, and a compound containing a zirconium or aluminum atom other than zirconium oxide and aluminum oxide, wherein a surface pH of the ink absorptive layer is 4 to 6 measured 30 minutes after receiving a water based ink of pH range 6 to 9 jetted from an ink jet printer in an amount of 20 ml/m$^2$.

8 Claims, No Drawings

INK JET RECORDING SHEET

FIELD OF THE INVENTION

The present invention relates to an ink jet recording sheet, and particularly to an ink jet recording sheet which exhibits excellent ink absorbability, minimizes bleeding, and results in stable color density under keeping in high humidity.

BACKGROUND OF THE INVENTION

In recent years, ink jet recording has increasingly resulted in enhancement of image quality which is approaching that of conventional photography. In order to achieve such conventional photographic quality, improvement has been made in the area of recording sheets. A void type recording sheet, which comprises a highly smoothened support having thereon a minute-void layer comprised of fine particles and hydrophilic polymers, exhibits high gloss, results in bright color formation, and exhibits excellent ink absorbability as well as ink drying properties. Accordingly, said recording sheet has been regarded as one of those which are most similar to conventional photographic quality. Specifically, when a non-water absorptive support is employed, it is possible to prepare high quality prints because cockling (wrinkling), which is noticed in a water absorptive support, is not present, and it is possible to maintain the highly smoothened surface.

Ink jet recording is mainly divided into two types; one in which ink, comprised of water-soluble dyes, is employed and the other in which ink, comprised of pigments, is employed. The ink comprised of pigments results in highly durable images but gloss tends to vary imagewise. As a result, it is difficult to prepare prints which exhibit conventional photographic quality. On the other hand, when an ink, comprised of water-soluble dyes, is employed, it is possible to obtain very bright and clear images of uniform gloss. Accordingly, it is possible to prepare color prints approaching conventional photographic quality.

However, ink, comprised of water-soluble dyes, results in disadvantages such as bleeding and poor water resistance due to the high hydrophilicity of said water-soluble dyes. Namely, when after printing, prints are stored at high humidity for a long period of time, or water droplets are allowed to adhere onto the print surface, said dyes tends to result in bleeding.

In order to overcome such drawbacks, it is a general practice to incorporate dye fixing materials such as cationic materials into a porous layer.

A method preferably employed is one in which, for example, an anionic dye is allowed to bond to a cationic polymer so as to be immobilized. Cited as such cationic polymers are polymers of quaternary ammonium salts, which are, for example, described in the conventional art of "Ink Jet Printer Gijutsu to Zairyo (Technology and Materials of Ink Jet Printers)", (published by CMC Co., Ltd., July 1998) and Japanese Patent Publication Open to Public Inspection No. 9-193532.

Further, a method has been proposed in which water-soluble polyvalent metal ions are previously incorporated into an ink jet recording sheet so that during ink jet recording, dyes are immobilized while being coagulated and fixed.

However, when such cationic polymers and water-soluble polyvalent inns are incorporated to minimize bleeding as well as to enhance water resistance, said dyes tend to coagulate on the surface. As a result, the image surface tends to result in a bronzing phenomena, in which the image surface exhibits a metallic gloss. Said bronzing tends to generally occur when prints are stored in a highly humid environment.

It has been known that compounds containing a zirconium atom and an aluminum atom are employed in ink jet recording sheets.

Japanese Patent Publication Open to Public Inspection Nos. 55-53591, 55-150396, 56-867789, 58-89391, and 58-94491 describe ink jet recording sheets comprised of water-soluble polyvalent metal salts which bond to water-soluble dyes to form minimally water-soluble salts.

Further, Japanese Patent Publication Open to Public Inspection Nos. 60-67190, 61-10484, and 61-57379 describe ink jet recording sheets comprised of cationic polymers as well as water-soluble polyvalent metal salts.

Japanese Patent Publication Open to Public Inspection No. 60-257286 describes an ink jet recording sheet comprised of basic polyhydroxyl aluminum compounds.

Further, Japanese Patent Publication Open to Public Inspection No. 10-258567 discloses a method employing a hydrophilic polymer and a water-soluble compound comprising a 4A group element, in combination, while Japanese Patent Publication Open to Public Inspection No. 10-309862 discloses a method employing a hydrophilic polymer together with a polyhydric carboxylic acid, and a zirconyl compound, also in combination.

Further, regarding compounds comprising said zirconium element, Japanese Patent Publication Open to Public Inspection No. 4-7189 discloses a method employing a porous pigment and an acid zirconium chloride compound. Said patent specification describes that by adding said acid zirconium chloride salt, desired adhesion strength is obtained employing a relatively small amount of binder, and it is possible to achieve improvement of image quality.

Japanese Patent Publication Open to Public Inspection No. 6-32046 discloses a method in which a zirconium compound is combined with silica and modified polyvinyl alcohol.

Further, European Patent No. 754,560 discloses that a water-soluble binder, a pigment, a zirconium compound, and a cationic polymer are employed in combination.

However, it was discovered that when water-soluble polyvalent metal salt, as above, were incorporated, problems occurred in which, when the added amount increased so as to obtain sufficient effects to minimize bleeding as well as to enhance water resistance, bronzing tended to occur. Further, it was also discovered that even though said basic polyaluminum hydroxide and zirconium oxychloride salts did not result in said problems, problems tended to occur in which the color of formed images tended to vary during storage after printing.

Namely, it was clarified that when an ink jet recording sheet comprising basic polyaluminum hydroxide and zirconium oxychloride in its ink absorptive layer was printed at high humidity, color variation tended to be greater compared to that printed at low humidity. As a result, immediate improvement has been demanded.

SUMMARY OF THE INVENTION

From the viewpoint of the foregoing, the present invention was achieved. An object of the present invention is to provide an ink jet recording sheet which exhibits minimized bleeding during storage after printing and improved water resistance under an application of water-soluble dyes, and exhibits excellent stability of color reproduction with respect to ambient humidity variation during printing.

Said object of the present invention was achieved employing the embodiments described below.

1. An ink jet recording sheet comprising a non-water absorptive support having thereon an ink absorptive layer comprising polyvinyl alcohol, a cationic polymer, and a compound containing a zirconium or aluminum atom other than zirconium oxide and aluminum oxide, wherein a surface pH of said ink absorptive layer is 4 to 6 measured 30 minutes after receiving a water based ink of pH range 6 to 9 jetted from an ink jet printer in an amount of 20 ml/m$^2$.

2. The ink jet recording sheet of item 1, wherein an average molecular weight of the cationic polymer is between 5,000 and 100,000.

3. The ink jet recording sheet of item 1, wherein the compound containing a zirconium atom is selected from the group consisting of zirconyl carbonate, ammonium zirconyl carbonate, zirconyl acetate, zirconyl nitrate, zirconium oxychloride, zirconium lactate, and zirconyl citrate.

4. The ink jet recording sheet of item 1, wherein the compound containing an aluminum atom is selected from the group consisting of aluminum chloride, basic aluminum chloride, aluminum sulfate, basic aluminum sulfate, and basic aluminum sulfate silicate.

5. The ink jet recording sheet of item 1, wherein the surface pH of said ink absorptive layer is 4.5 to 5.5 measured 30 minutes after receiving a water based ink of pH range 6 to 9 jetted from an ink jet printer in an amount of 20 ml/m$^2$.

6. The ink jet recording sheet of item 1, wherein the ink absorptive layer is a porous layer.

7. The ink jet recording sheet of item 1, wherein said ink absorptive layer comprises boric acid or a salt thereof in an amount of 2 to 30 millimol per m$^2$ of said ink absorptive layer, and a surface pH of said ink absorptive layer prior to receiving ink is from 3.5 to 5.5.

8. The ink jet recording sheet of item 1, wherein said cationic polymer is represented by Formula (1), Formula (1)

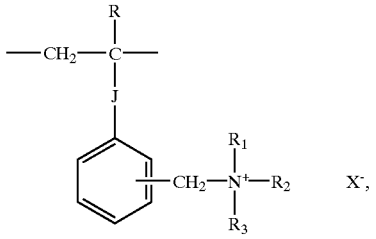

wherein R represents a hydrogen atom or an alkyl group; $R_1$, $R_2$, and $R_3$ each represent an alkyl group or a benzyl group; J represents a bond or a divalent organic group; $X^-$ represents an anion group.

9. The ink jet recording sheet of item 1, wherein said ink absorptive layer comprises at least two ink absorptive layers, wherein said cationic polymer in said ink absorptive layer farthest from said non-water absorptive support comprises a repeating unit represented by Formula (1), Formula (1)

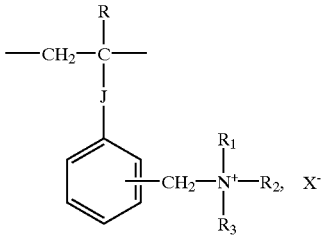

wherein R represents a hydrogen atom or an alkyl group; $R_1$, $R_2$, and $R_3$ each represent an alkyl group or a benzyl group; J represents a bond or a divalent organic group; $X^-$ represents an anion group.

The inventors of the present invention performed diligent investigations to overcome said problems. As a result, it was discovered that by incorporating polyvinyl alcohol, specified cationic polymers, and specified compounds comprising zirconium or aluminum atoms, it was possible to minimize bleeding and improve water resistance without the resulting bronzing. Further, it was also discovered that the layer surface pH of said ink absorptive layer was closely related to color variation due to humidity variation, and by adjusting said layer surface pH in the range of 4 to 6, color reproducibility at varied humidity, especially at high humidity was greatly improved. Based on said discoveries, the present invention was achieved.

DETAILED DESCRIPTION OF THE INVENTION

The present invention will now be detailed. An ink jet recording sheet of the present invention comprises a support having thereon an ink absorptive layer comprised of polyvinyl alcohol, a cationic polymer, and a compound selected from the group of compounds containing a zirconium atom or an aluminum atom with excluding zirconium oxide and aluminum oxide, and the surface pH of the ink jet sheet after printed with an ink jet printer is from 4 to 6.

<Polyvinyl Alcohol>

Polyvinyl alcohol incorporated into the ink jet recording sheet of the present invention will now be described.

Polyvinyl alcohol employed in the present invention include common polyvinyl alcohol prepared by hydrolyzing polyvinyl acetate, and in addition, modified polyvinyl alcohol such as terminal cation-modified polyvinyl alcohol and anion-modified polyvinyl alcohol having an anionic group.

The average degree of polymerization of polyvinyl alcohol prepared by hydrolyzing vinyl acetate is preferably 1,000 or more, and is more preferably from 1,500 to 5,000. Further, the saponification ratio is preferably from 70 to 100 percent, and is more preferably from 80 to 99.5 percent.

Further, various types of polyvinyl alcohols, in which the degree of polymerization, the degree of saponification, or modification is different, may be employed in combination of at least two types.

The amount of polyvinyl alcohol is preferably 0.5 to 10 g per 1 m$^2$ of the ink jet recording sheet.

In addition to said polyvinyl alcohols, hydrophilic polymers may be incorporated into the ink absorptive layer of the ink jet recording sheet of the present invention.

Listed as examples of said hydrophilic polymers may be, for example, gelatin, polyethylene oxide, polyvinylpyrrolidone, casein, starch, agar, carrageenan, polyacrylic acid, polymethacrylic acid, polyacryl amide, polymethacrylamide, polystyrene sulfonic acid, cellulose, carboxymethyl cellulose, hydroxyethyl cellulose, dextran, and pullulan. The added amount of these hydrophilic polymers may be preferably in the range of 0 to 50 percent by weight with polyvinyl alcohol, and may be most preferably in the range of 0 to 20 percent by weight.

<Cationic Polymers>

The cationic polymers employed in the ink jet recording sheet of the present invention will now be described.

The cationic polymers employed in the ink jet recording sheet of the present invention are not specifically limited. Conventionally known cationic polymers used in ink jet recording sheets can be used.

Listed as examples of cationic polymers having a quaternary ammonium salt group employed in claim 1 of the present invention may be cationic polymers having a guanydyl group described in Japanese Patent Publication Open to Public Inspection No. 57-64591, dimethyldiallylammonium chloride described in Japanese Patent Publication Open to Public Inspection No. 59-20696, polyaminesulfones described in Japanese Patent Publication Open to Public Inspection No. 59-33176, acrylic acid alkyl quaternary ammonium salts or methacrylic acid alkyl quaternary ammonium salts, or acrylamide alkyl quaternary ammonium salt type or methacrylamide alkyl quaternary ammonium salt type cationic polymers described in Japanese Patent Publication Open to Public Inspection No. 63-115780, copolymers of dimethylallylammonium chloride and acrylamide described in Japanese Patent Publication Open to Public Inspection Nos. 64-9776 and 64-75281, cationic polymers containing at least two quaternary nitrogen atoms in the repeating units described in Japanese Patent Publication Open to Public Inspection No.3-133686, polyvinylpyrrolidone having a quaternary ammonium salt group described in Japanese Patent Publication Open to Public Inspection No. 4-288283, cationic polymers prepared by allowing secondary amine to react with epihalohydrin described in Japanese Patent Publication Open to Public Inspection Nos. 6-92010 and 6-234268, polystyrene type cationic polymers described in International Patent Publication Open to Public Inspection No. 99-64248, and cationic polymers comprised of repeating units having at least two cationic groups described in Japanese Patent Publication Open to Public Inspection No. 11-348409.

Preferred cationic polymers used in the present invention have a repeating unit represented by Formula I.

R is preferably a methyl group. Preferable alkyl groups represented by $R_1$, $R_2$, and $R_3$ are a methyl group, an ethyl group or a benzyl group. A preferable divalent organic group represented by J is —CON(R')—, in which R' represents a hydrogen atom or an alkyl group.

Examples of an anion represented by X are; a halogen ion, an acetoxyl ion, a methyl sulfate ion and p-toluenesulfonate ion.

Preferred cationic polymers may be homopolymers having a repeating unit represented by Formula I, and also may be copolymers with a monomer which can polymerize. Examples of monomers which can polymerize to form copolymers are those having other cation unit than that represented by Formula I and monomers without a cation unit.

Listed as specific examples of monomers having a cation group are as follows.

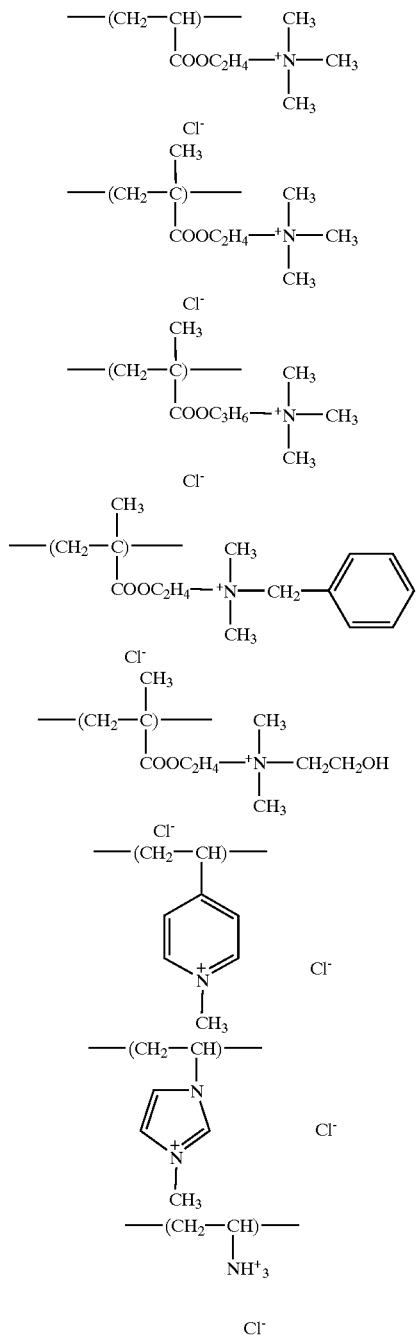

Examples of repeating units which do not contain a cationic group are; ethylene, styrene, butadiene, methyl methacrylate, ethyl methacrylate, propyl methacrylate, butyl methacrylate, octyl methacrylate, methyl acrylate, ethyl acrylate, propyl acrylate, butyl acrylate, octyl acrylate, hydroxyethyl methacrylate, acrylamide, vinyl acetate, vinyl methyl ether, vinyl chloride, 4-vinylpyridine, N-vinylpyrrolidone, N-vinylimidazole and acrylonitrile.

When cationic polymers have a repeating unit represented by Formula I, the content ratio of said repeating units is preferably at least 20 mol percent of said cationic polymers, and is more preferably 40 to 100 mol percent.

Specific examples of the cationic polymers having a repeating group are illustrated below. The present invention is not limited by these examples.

P-1
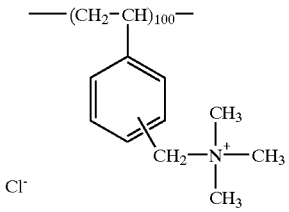
P-2
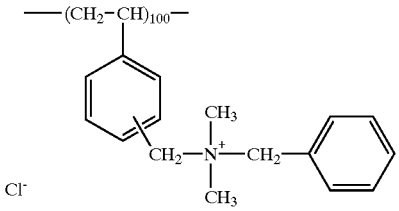
P-3
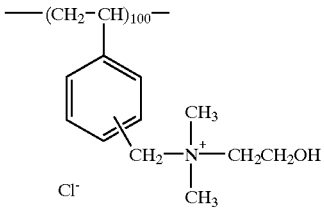
P-4
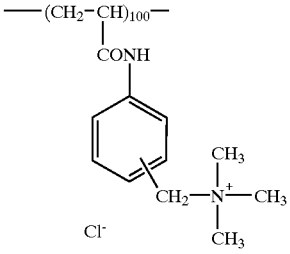
P-5
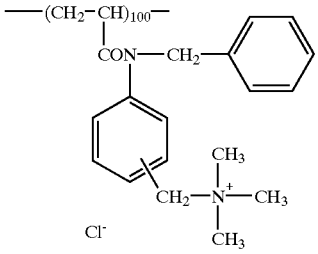
P-6
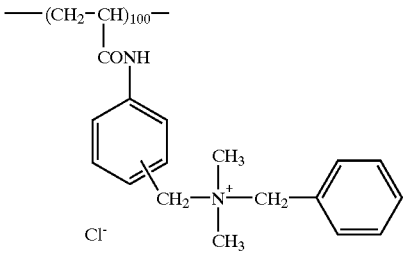
-continued
P-7
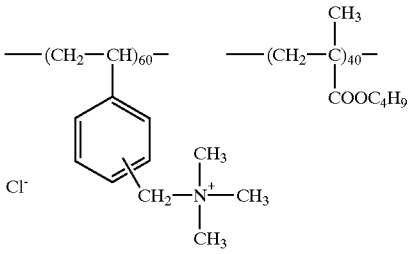
P-8
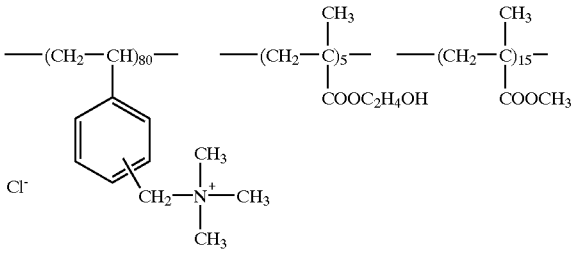
P-9
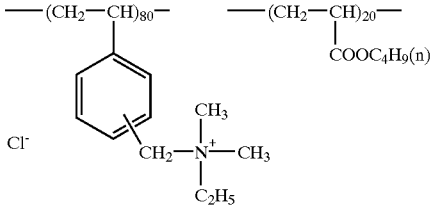
P-10
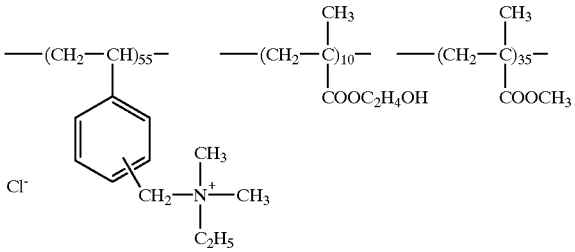
P-11
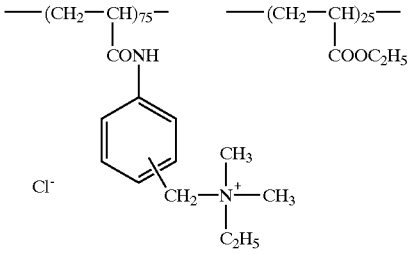
P-12
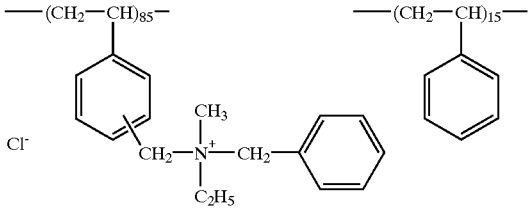

-continued

P-13

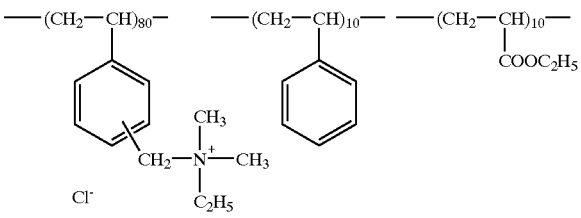

P-14

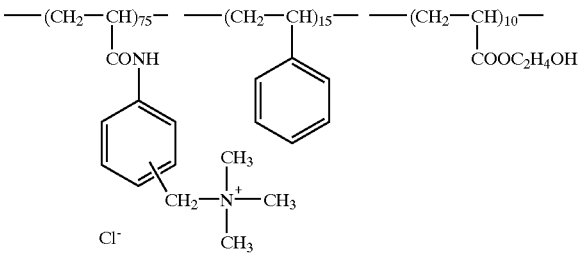

P-15

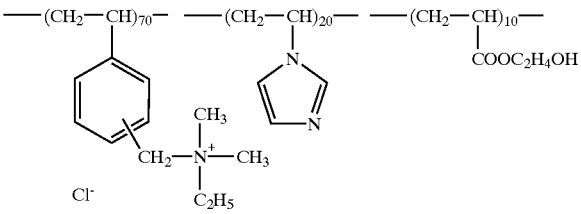

P-16

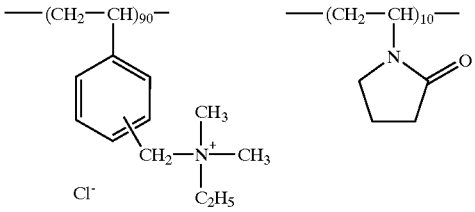

P-17

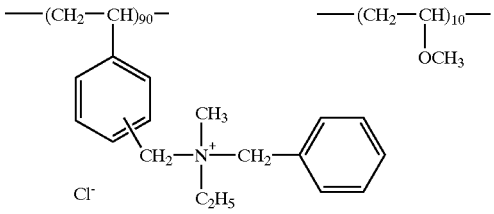

P-18

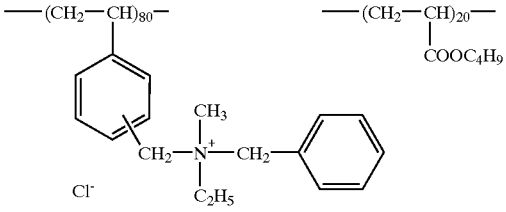

-continued

P-19

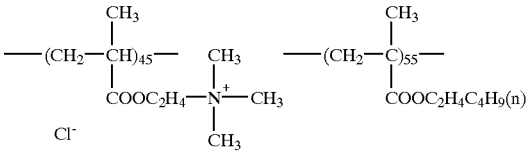

The average molecular weight of cationic polymers according to the present invention is preferably in the range of 3,000 to 200,000, and is more preferably in the range of 5,000 to 100,000.

The average molecular weight, as described herein, refers to the number average molecular weight, and also refers to ethylene glycol converted values obtained employing gel permeation chromatography.

The amount of cationic polymers employed in the present invention is commonly in the range of 0.1 to 10 g per $m^2$ of said recording sheet, and is preferably from 0.2 to 5 g.

<Compounds Containing a Zirconium Atom or an Aluminum Atom>

Compounds containing a zirconium atom or an aluminum atom employed in the present invention are detailed.

The compounds (however, excluding zirconium oxide and aluminum oxide) containing a zirconium atom or an aluminum atom may be either water-soluble or non-water soluble, as long as those can be uniformly incorporated into said ink absorptive layer.

Said compounds containing a zirconium atom or an aluminum atom, which are usable in the present invention, may be any of the single or double salts of inorganic or organic acids, organic metal compounds, or metal complexes.

Listed as specific examples of zirconium atom containing compounds which are usable in the present invention are zirconium difluoride, zirconium trifluoride, zirconium tetrafluoride, hexafluorozirconate (for example, potassium salts), heptafluorozirconate (for example, sodium salts, potassium salts, and ammonium salts), octafluorozirconate (for example, lithium salts), zirconium fluoride oxide, zirconium dichloride, zirconium trichloride, zirconium tetrachloride, hexachlorozirconate (for example, sodium salts and potassium salts), zirconium oxychloride (zirconyl chloride), zirconium dibromide, zirconium tribromide, zirconium tetrabromide, zirconium bromide oxide, zirconium triiodide, zirconium tetraiodide, zirconium peroxide, zirconium hydroxide, zirconium sulfide, zirconium sulfate, zirconium p-toluenesulfonate, zirconyl sulfate, sodium zirconyl sulfate, acidic zirconyl sulfate trihydrate, potassium zirconyl sulfate, zirconium selenate, zirconium nitrate, zirconyl nitrate, zirconium phosphate, zirconium carbonate, ammonium zirconyl carbonate, zirconium acetate, zirconyl acetate, ammonium zirconyl acetate, zirconyl lactate, zirconyl citrate, zirconyl stearate, zirconium phosphate, zirconyl phosphate, zirconium oxalate, zirconium isopropionate, zirconium butyrate, zirconium acetylacetonate, acetyl acetone zirconium butyrate, zirconium stearate butyrate, zirconium acetate, and bis(acetylacetonato)dichlorozirconium, and tris (acetylacetonato)chlorozirconium.

Of these compounds containing a zirconium atom, preferred are zirconyl carbonate, ammonium zirconyl carbonate, zirconyl acetate, zirconyl nitrate, zirconium oxychloride, zirconium lactate, and zirconyl citrate. Most preferred compounds are ammonium zirconyl carbonate and zirconyl acetate.

Listed as specific examples of aluminum atom containing compounds which are usable in the present invention are aluminum fluoride, hexafluoroaluminate (for example, potassium salts), aluminum chloride, basic aluminum chloride (polyaluminum chloride), tetrachloroaluminate (for example, sodium salts), aluminum bromide, tetrabromoaluminate (for example, potassium salts), aluminum iodide, aluminate (for example, sodium salts, potassium salts, and calcium salts), aluminum chlorate, aluminum perchlorate, aluminum thiocyanate, aluminum sulfate, basic aluminum sulfate, aluminum sulfate potassium (alum), ammonium aluminum sulfate (ammonium alum), sodium sulfate aluminum, aluminum phosphate, aluminum nitrate, aluminum hydrogenphosphate, aluminum carbonate, polyaluminum sulfate silicate, aluminum formate, aluminum acetate, aluminum lactate, aluminum oxalate, aluminum isopropionate, aluminum butyrate, ethyl acetate aluminum diisopropionate, aluminum tris(acrtylacetonate), aluminum tris(ethylacetoacetate), and aluminum monoacetylacetonatebis(ethylacetoacetate).

Of these, preferred are aluminum chloride, basic aluminum chloride, aluminum sulfate, basic aluminum sulfate, and basic aluminum sulfate silicate.

Said compounds containing a zirconium atom or an aluminum atom may be incorporated into an ink absorptive layer forming coating composition. The resulting coating composition is coated and subsequently dried. Alternatively, after coating and drying a porous layer, said compounds may be incorporated into said ink absorptive layer, employing an overcoating method.

Said compounds containing a zirconium atom or an aluminum atom are dissolved in water, organic solvents, or a solvent mixture consisting of water and said organic solvents are dispersed into fine particles, employing a wet crushing method such as a sand mill or a method such as emulsifying dispersion. The resulting solution or dispersion may be added to an ink absorptive layer forming coating composition. When said ink absorptive layer is comprised of a plurality of layers, the resulting solution or dispersion may be added to only one layer, at least two layers or coating compositions forming all layers.

Further, when after forming a porous ink absorptive layer, said compounds are added employing said overcoating method, it is preferable that they are uniformly dissolved in solvents and the resulting solution is then added.

The used amount of said compounds containing a zirconium atom or an aluminum atom is generally in the range of 0.01 to 5 g per $m^2$ of the ink jet recording sheet, is preferably in the range of 0.05 to 2 g, and is most preferably in the range of 0.1 to 1 g.

Said compounds may be employed in combination of at least two types. In this case, zirconium atom containing compounds may be employed in combination of at least two types, aluminum containing compounds may be employed in combination of at least two types, or compounds containing a zirconium atom and compounds containing an aluminum atom may be employed in combination.

(Layer Surface pH)

In the invention according to claim 1, one of the characteristics is that the layer surface pH of said ink absorptive layer after printing is from 4 to 6. Further, in the invention according to claim 2, one of the characteristics is that the layer surface pH of said ink absorptive layer prior to printing is from 3.5 to 5.5.

When the layer surface pH of said ink absorptive layer after printing is less than 4, bronzing on the ink absorptive layer surface tends to occur. Further, when said pH exceeds 6, the effects of the present invention are deteriorated in such a manner that color variation due to ambient humidity variation is enhanced. The particularly preferred layer surface pH after printing is from 4.5 to 5.5.

The layer surface pH, as described herein, is the value determined employing the method specified in J. TAPPI Paper Pulp Test Method No. 49-86. An approximately 50 $\mu$l pure water droplet, having a pH of 6.2 to 7.3, is allowed to drip onto the ink absorptive layer surface of the print prepared by printing solid images utilizing a black ink, and the resulting pH is determined while pressing a flat electrode.

It is possible to adjust the layer surface pH after printing to the layer surface pH range specified in the present invention by suitably adjusting the layer surface pH of the ink absorptive layer, prior to printing, or by suitably adding an acid buffer into the ink absorptive layer.

In the present invention, the preferred layer surface pH of the ink absorptive layer prior to printing is from 3.5 to 5.5.

Generally, in order to minimize coagulation of acidic dyes, the pH of ink is often beyond the acidic region, and the pH is commonly from about 6 to about 9. However, when ink, having such a relatively high pH, is employed, the layer surface pH after printing tends to increase. As a result, the layer surface pH after printing exceeds 6.

When the layer surface pH after printing exceeds 6, said color variation tends to occur due to ambient humidity variation during printing. At present, the cause is not clear, but the reason described below may be considered as one of causes.

Namely, it is assumed that, generally, compounds containing zirconium or aluminum atoms tend to form their oxides in the region of relatively high pH. It is also assumed that formed zirconium or aluminum oxides somewhat affect devitrification of said layer and since each of yellow, magenta, and cyan dyes is fixed at positions of different depth, said devitrification resulting in the entire ink absorptive layer is a factor resulting in color variation. Further, it is also assumed that when ambient humidity varies during printing, the evaporation rate of water in ink varies, and as a result, the hysterisis of water content variation in the layer differs, resulting in a difference in the formed amount of oxides as well as shape (such as the particle diameter), followed by resulting in color variation.

As a mechanism of the improvement of the present invention, it is assumed that oxide formation after printing, as above, is minimized, and as a result, effects are exhibited which minimize said color variation. In order to effectively minimize oxide formation after printing, maintaining the layer surface of the ink absorptive layer at a low pH is an effective means while taking into account said assumption, and adjusting the layer surface pH to no higher than 6 is a particularly effective means.

Further, another effective means is that a pH buffer, which functions as an acid, is incorporated so that when an ink having a relatively high pH is absorbed, it is possible to minimize an increase in the layer surface pH after printing.

pH buffer agents are preferably weak acids and include, for example, boric acid, carbonic acid or various types of organic acids. Of these, carbonic acid is not useful because it tends to generate carbon dioxide gas at low pH levels and tends to result in various problems during preparation of coating compositions as well as during coating. Listed as preferred weak acids are boric acid as well as organic acids.

Listed as said organic acids may be, for example, various types of organic acids such as non-volatile phthalic acid, terephthalic acid, salicylic acid, benzoic acid, sebacic acid, lauric acid, palmitic acid, citric acid, malic acid, lactic acid, succinic acid, oxalic acid, polyacrylic acid, and benzilic acid. Said various types of weak acids may be employed individually, or sodium or potassium salts thereof may be partly employed. The feature of the invention according to claim 2 is that boric acid, or salts thereof, and organic acids, or salts thereof, are incorporated into said ink absorptive layer in an amount of 2 to 20 millimol per $m^2$.

Boric acid is preferably sued in the present invention.

Boric acid and salts thereof, employed in the present invention, refer to oxygen acid having a boron atom as the central atom and/or salts thereof, and specifically include orthoboric acid, diboric acid, metaboric acid, tetraboric acid, pentaboric acid, and octaboric acid, and salts thereof.

The amount of boric acid and/or salts thereof used varies and depends on the types of polyvinyl alcohol, the types of cross-linking agents, the types of fine inorganic particles, and the ratio with respect to polyvinyl alcohol. However said used amount is commonly from 5 to 500 mg per g of said polyvinyl alcohol, and is preferably from 10 to 300 mg.

<Components of the Ink Jet Recording Sheet>

The other components which are incorporated in the ink jet recording sheet of the present invention will be described below.

The ink absorptive layer of the present invention may be so called a swelling type and a void type.

A swelling type ink absorptive layer comprises a hydrophilic binder as a main portion, and a void type ink absorptive layer comprises a small amount of binder and a large amount of fine particles. In order to achieve high ink absorptivity, a void type ink absorptive layer is preferred in the present invention.

The fine particles used in the void type ink absorptive layer of the present invention are preferably inorganic fine particles by considering the properties to yield high color density and forming small particles.

Fine inorganic particles employed in the ink jet recording sheet of the present invention will now be described.

Employed as said fine inorganic particles my be various types of fine solid particles conventionally known in the art of ink jet recording sheets.

Cited as examples of said fine inorganic particles may be white inorganic pigments such as precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

Said fine particles may be employed in such a state that primary particles are uniformly dispersed in binders without any modification, or in such a state that secondary coagulated particles are formed which are dispersed into the binders. However, the latter is preferred.

The shape of said fine inorganic particles is not particularly limited and may be spherical, cylindrical, acicular, tabular, or rosary-shaped.

The average diameter of the primary particles of said fine inorganic particles is preferably from 3 to 30 nm.

When fine primary particles, having a diameter of 30 nm or more, are employed, it is difficult to obtain clear and bright images due to a decrease in glossiness of the recording sheet or a decrease in maximum density due to diffused surface reflection. The lower limit of the average diameter of said primary particles is also not particularly limited, but from the viewpoint of producing said particles, the diameter is commonly at least about 3 nm, and is preferably at least 6 nm.

The average diameter of said fine particles may be obtained as follows. Said particles themselves, or the cross-section or surface of a void layer, is observed employing an electron microscope, and each diameter of many randomly selected particles is determined. The simple average (being the number average) is obtained as the diameter of said particles based on the determined diameter. Herein, each particle diameter is represented by the diameter of the circle having the same projection area as that of said particle.

Composite particles comprised of fine inorganic particles and a small amount of organic materials (which may be either lower molecular weight compounds or polymers) are basically designated as the fine inorganic particles according to the present invention. Even in this case, the diameter of the highest order particles observed in the dried layer is determined as that of the fine inorganic particles.

The ratio of organic materials/fine inorganic particles in said composite particles comprised of fine inorganic particles and a small amount of organic materials is generally from 1/100 to 1/4.

Preferred as the fine inorganic particles according to the present invention are those which are less expensive, have a low refractive index from the viewpoint of being capable of producing a high reflection density. Of those, silica, especially silica synthesized employing a gas phase method or colloidal silica, is more preferred.

Further, it is possible to employ cation surface-treated silica synthesized employing a gas phase method, cation surface-treated colloidal silica and alumina, colloidal alumina, and pseudo boehmite.

The added amount of fine inorganic particles, employed in the ink absorptive layer, varies largely depending on the desired ink absorption capacity, the void ratio of the void layer, the types of fine inorganic particles, and the types of hydrophilic binders, but is generally from 3 to 30 g per $m^2$ of the recording sheet, and is preferably from 5 to 25 g. The ratio of fine inorganic particles to polyvinyl alcohol, employed in said ink absorptive layer, is generally from 2:1 to 20:1, and is preferably from 3:1 to 10:1.

Supports employed in the recording sheet of the present invention will now be described.

Employed as supports of the ink jet recording sheet of the present invention is a non-water absorptive support. When a water absorptive support is employed, a compound containing a zirconium atom or an aluminum atom which forms an ink absorptive layer may diffuse into the support during layer making or during storage. As a result, the effect of the present invention cannot be fully achieved.

Listed as non-water absorptive supports are plastic resinous film supports and supports prepared by covering both sides of paper with a resinous film.

Listed as plastic resinous film supports are polyester film, polyvinyl chloride film, polypropylene film, cellulose triacetate film, and polystyrene film, or film supports obtained by laminating any of these. Of these plastic resinous films, either transparent or translucent supports may be employed.

In the present invention, non-water absorptive supports are preferred, which result in no wrinkling during printing. Particularly preferred supports are those prepared by covering both sides of the paper base with plastic resins, and the most preferred supports are those prepared by covering both sides of the paper base with polyolefin resins.

The supports prepared by covering both sides of said paper with polyolefin resins will now be described, which are preferably employed in the present invention.

Paper employed in the supports of the present invention is made employing wood pulp as the main raw material and in addition, if desired, synthetic pulp such as polypropylene and synthetic fiber such as nylon and polyester. Employed as said wood pulp may be any of LBKP, LBSP, NBKP, NBSP, LDP, NDP, LUKP, and NUKP. However, it is preferable that LBKP, NBSP, LBSP, NDP, and LDP comprising short fiber component in a relatively large amount are preferably employed in a larger amount. Incidentally, the ratio of LBSP and/or LDP is preferably from 10 to 70 percent.

Preferably employed as said pulp is chemical pulp (sulfate pulp and sulfite pulp) comprising minimal impurities. Further, also useful is pulp which has been subjected to a bleaching treatment to increase its whiteness.

Suitably incorporated into said paper may be sizing agents such as higher fatty acids and alkylketene dimer; white pigments such as calcium carbonate, talc, and titanium oxide; paper strength enhancing agents such as starch, polyacrylamide, and polyvinyl alcohol; optical brightening agents; moisture retention agents such as polyethylene glycols; dispersing agents; and softeners such as quaternary ammonium.

The degree of water freeness of pulp employed for paper making is preferably between 200 and 500 ml according to CSF Specification. Further, the sum of the weight percent of 24-mesh residue and the weight percent of 42-mesh calculated portion regarding the fiber length after beating, specified in JIS P 8207, is preferably between 30 and 70 percent. Further, the weight percent of 4-mesh residue is preferably 20 percent by weight or less.

The weight of said paper is preferably from 50 to 250 $g/m^2$, and is most preferably from 70 to 200 g. The thickness of said paper is preferably from 50 to 210 $\mu$m.

During the paper making stage, or alternatively after paper making, said paper may be subjected to a calendering treatment resulting in excellent smoothness. The density of said paper is generally from 0.7 to 1.2 $g/m^2$ (JIS P 8118). Further, the stiffness of said paper is preferably from 20 to 200 g under the conditions specified in JIS P 8143.

Surface sizing agents may be applied onto the paper surface. Employed as said surface sizing agents may be the same as those above, capable of being incorporated into said base paper.

The pH of said paper, when determined employing a hot water extraction method specified in JIS P 8113, is preferably from 5 to 9.

Polyolefin resins, which cover both sides of said paper, will now be described.

Preferably employed as polyolefin resins to achieve said purposes are polyethylene, polypropylene, polyisobutylene, and polyethylene. Of these, polyolefins such as copolymers comprised of propylene as the main component are preferred, and polyethylene is particularly preferred.

The particularly preferred polyethylene will now be described.

Polyethylene, which covers both surfaces of paper, is mainly comprised of low density polyethylene (LDPE) and/or high density polyethylene (HDPE), but it is also possible to partially employ LLDPE and polypropylene.

Specifically, rutile or anatase type titanium dioxide is preferably incorporated into the polyolefin layer on the coating layer side so as to improve opacity as well as whiteness. The content ratio of said titanium oxide is commonly from 1 to 20 percent with respect to the polyolefin, and is preferably from 2 to 15 percent.

High heat resistant color pigments and optical brightening agents for adjusting white background may be incorporated into said polyolefin layer.

Listed as said color pigments are ultramarine, Prussian blue, cobalt blue, phthalocyanine blue, manganese blue, cerulean, tungsten blue, molybdenum blue, and anthraquinone blue.

Listed as said optical brightening agents are dialkylaminocoumarin, bisdimethylaminostilbene, bismethylaminostilbene, 4-alkoxy-1,8-naphthalenenedicaroxylic acid-N-alkyklimide, bisbenzoxazolylethylene, and dialkylstilbene.

The amount of polyethylene used on both surfaces of paper is selected so as to optimize curling at low and high humidity after providing an ink absorptive layer as well as a backing layer. The thickness of the polyethylene layer on the ink absorptive layer side is generally in the range of 15 to 50 $\mu$m, while said thickness on the backing layer side is generally from 10 to 40 $\mu$m. It is preferable that the ratio of polyethylene on the front surface to that on the opposite surface is determined to optimize curling which varies depending on the type and thickness of the ink receptive layer and the thickness of the core paper. Said polyethylene ratio of the front surface/opposite surface is generally from about 3/1 to about 1/3 in terms of the thickness.

Further, it is preferable that said polyethylene coated support exhibits characteristics (1) through (7), described below.

(1) Tensile strength is preferably from 2 to 30 kg in the longitudinal direction and from 1 to 20 kg in the lateral direction, in terms of the strength specified in JIS P 8113.
(2) Tear strength is preferably from 20 to 300 g in the longitudinal direction and from 10 to 250 g in the lateral direction, in terms of the strength specified in JIS P 8116.
(3) Compressive elasticity modulus is preferably at least 9.8 $kN/cm^2$.
(4) Opacity is preferably at least 80 percent and is most preferably from 85 to 98 percent, when determined employing the method specified in JIS P 8138.
(5) Preferable whiteness of L*, a*, and b*, specified in JIS Z 8727, are to be in the following range: L* from 80 to 96; a* from −3 to +5; and b* from −7 to +2.
(6) Clark stiffness of the support is preferably from 50 to 300 $cm^2/100$ in the recording sheet conveying direction.
(7) Moisture of said paper is to be from 4 to 10 percent with respect to the core paper.
(8) Glossiness (75-degree specular glossiness) of the support, on which the ink receptive layer is provided, is preferably 10 to 90 percent.

The ink absorptive layer of the present invention may be a single layer or comprises multiple layers. Multiple layers are preferred because they show a smaller change of color density caused by the atmospheric humidity variation. One of the embodiments of the present invention has an ink absorptive layer composed of at least two layers, and the layer from the non-water absorptive support contains a cationic polymer having a repeating group represented by Formula I.

The ink jet recording sheet of the present invention may comprise hardeners.

Generally, hardeners are compounds having a group capable of reacting with polyvinyl alcohol or compounds which accelerate the reaction between different groups incorporating polyvinyl alcohol. Listed as such hardeners are epoxy based hardeners (diglycidyl ethyl ether, ethylene glycol diglycidyl ether, 1,4-butanediol diglycidyl ether, 1,6-diglycidylcyclohexane, N,N-glycidyl-4-glycidyloxyaniline, sorbitol polyglycidyl ether, and glycerol polyglycidyl ether), aldehyde based hardeners (formaldehyde and glyoxal), active halogen based hardeners (2,4-dichloro-4-hydroxy-1,3,5-s-trizine), and active vinyl based compounds (1,3,5-trisacryloyl-hexahydro-s-triazine, bisvinylsulfonyl methyl ether), aluminum alum, and isocyanate compounds.

The amount of hardeners used varies, depending on the types of polyvinyl alcohol, the types of hardeners, the types of fine inorganic particles and the ratio with respect to polyvinyl alcohol. However, said amount is generally from 5 to 500 mg per g-of the polyvinyl alcohol, and is preferably from 10 to 300 mg.

In addition to said additives, various other additives may be incorporated into the ink absorptive layer as well as other layers provided, as required of the ink recording sheet of the present invention.

The following various types of additives, known in the art, may also be incorporated: for example, polystyrene, polyacrylic acid esters, polymethacrylic acid esters, polyacrylamides, polyethylene, polypropylene, polyvinyl chloride, polyvinylidene chloride, or copolymers thereof; minute organic latex particles of urea resins or melamine resins; various types of cationic or nonionic surface active agents; UV absorbers described in Japanese Patent Publication Open to Public Inspection Nos. 57-74193, 57-87988, and 62-261476; anti-fading additives described in Japanese Patent Publication Open to Public Inspection Nos. 57-74192, 57-87989, 60-72785, 61-146591, 1-95091, and 3-13376; optical brightening agents described in Japanese Patent Publication Open to Public Inspection Nos. 59-42993, 59-52689, 62-280069, 61-242871, and 4-219266; pH regulators such as sulfuric acid, phosphoric acid, citric acid, sodium hydroxide, potassium hydroxide, and potassium carbonate; antifoaming agents, antiseptics, thickeners, antistatic agents, and matting agents.

It is possible to apply various types of ink absorptive layers and sublayers of the ink jet recording paper of the present invention, which are provided as required, onto a support, employing a method suitably selected from those known in the art. The preferred methods are such that the coating composition constituting each layer is applied onto a support and subsequently dried. In this case, it is possible to simultaneously apply at least two layers onto said support, and simultaneous coating is particularly preferred in which all hydrophilic binder layers are simultaneously coated.

Employed as coating methods are a roll coating method, a rod bar coating method, an air knife coating method, a spray coating method, and a curtain coating method. In addition, preferably employed is the extrusion coating method employing a hopper, described in U.S. Pat. No. 2,681,294.

When images are recorded employing the ink jet recording sheet of the present invention, a recording method, employing a water-based ink, is preferably utilized.

The water-based ink, as described herein, refers to a recording liquid comprised of colorants and liquid media described below, as well as other additives. Employed as said colorants are direct dyes, acidic dyes, basic dyes, reactive dyes, water-soluble food dyes, or water-dispersible pigments, which are known in the art of ink jet printing.

Listed as solvents in said water-based ink are water and various water-soluble organic solvents, including for example, alcohols such as methyl alcohol, isopropyl alcohol, and butyl alcohol, tert-butyl alcohol, and isobutyl alcohol; amides such as dimethylformamide and dimethylacetamide; ketones or ketone alcohols such as acetone and diacetone alcohol; ethers such as tetrahydrofuran and dioxane; polyalkylene glycols such as polyethylene glycol and polypropylene glycol; polyhydric alcohols such as ethylene glycol, propylene glycol, butylene glycol, triethylene glycol, 1,2,6-hexanetriol, thioglycol, hexylene glycol, diethylene glycol, glycerin, and triethanolamine; and lower alkyl ethers of polyhydric alcohols such as ethylene glycol methyl ether, diethylene glycol methyl (or ethyl) ether, and triethylene glycol monobutyl ether.

Of these, preferred are polyhydric alcohols such as diethylene glycol, triethanolamine, and glycerin, and lower alkyl esters of polyhydric alcohols such as triethylene glycol monobutyl ether.

Listed as other water-based ink additives are, for example, pH regulators, metal sequestering agents, fungicides, viscosity modifiers, surface tension controlling agents, wetting agents, surface active agents, and antirusting agents.

In order to improve the wettability of said water-based ink to said recording sheet, said water-based ink generally exhibits a surface tension in the range of 0.025 to 0.060 N/m at 20° C., and preferably in the range of 0.030 to 0.050 N/m. The pH of said water-based ink is preferably 5 to 10, and is more preferably 6 to 9.

EXAMPLES

The present invention will now be specifically described with reference to examples. However, the embodiments of the present invention are not to be construed as being limited to these examples. Incidentally, "percent" in the examples is percent by weight unless otherwise specified.

Example 1

(Preparation of Support)

Low density polyethylene, having a density of 0.92, was applied employing an extrusion coating method at a thickness of 35 $\mu$m onto the rear surface of a 200 g/m$^2$ weight photographic base paper, having a moisture content of 6.0 percent. Subsequently, low density polyethylene, having a density of 0.92, comprising 5.5 percent of anatase type titanium oxide was applied at a thickness of 40 $\mu$m onto the surface employing a melt extrusion coating method, whereby a support, coated on both sides with polyethylene, was prepared. Subsequently, the surface side was subjected to corona discharge, and a sublayer comprised of polyvinyl alcohol was applied onto the resulting surface to achieve a coated weight of 0.03 g/m$^2$. After applying said corona discharge to the rear surface, a latex layer was applied to achieve a coated weight of 0.12 g/m$^2$.

(Preparation of Recording Sheet 1)

<<Preparation of Silica Dispersion 1>>

Employing a jet stream-inductor mixer, TDS, manufactured by Mitamura Riken Kogyo Co., 160 kg of gas phase method silica, QS-20, (manufactured by Tokuyama), having an average primary article diameter of about 12 nm, were suction-dispersed at room temperature into 480 L of pure water, having a pH of 3.0, adjusted with nitric acid, and subsequently, the total volume was adjusted to 600 L employing pure water.

<<Preparation of Silica Dispersion 2>>

While stirring, added to 15 L of an aqueous solution (at a pH of 4.0) comprising 2.12 kg of cationic polymer (Exemplified Example P-19), 2.2 L of ethanol, and 1.1 L of n-propanol were 60.0 L of Silica Dispersion 1. Subsequently, 8.0 L of an aqueous solution, containing 80 g of borax, were added to the resulting mixture, followed by the addition of 200 ml of an aqueous solution containing 2 g of antifoaming agent SN381, manufactured by Sun Nobco Co.

The resulting mixture was dispersed employing a high pressure homogenizer, manufactured by Sanwa Kogyo Co., Ltd., and the total volume was adjusted to 85 L, employing pure water, whereby Silica Dispersion 2 was prepared.

<<Preparation of Silica Dispersion 3>>

While stirring, added to 15 L of an aqueous solution (at a pH of 4.0) comprising 2.12 kg of cationic polymer (Exemplified Example P-1), 4.2 L of ethanol, and 1.1 L of n-propanol were 60.0 L of Silica Dispersion 1. Subsequently, 8.0 L of an aqueous solution containing 80 g of borax were added to the resulting mixture, followed by the addition of 5 g of anionic optical brightening agent Uvitex NFW Liquid (manufactured by Ciba Specialty Chemical Co.).

The resulting mixture was dispersed employing a high pressure homogenizer, manufactured by Sanwa Kogyo Co., Ltd., and the total volume was then adjusted to 85 L, employing pure water, whereby Silica Dispersion 3 was prepared.

<<Preparation of Oil Dispersion 1>>

8.4 kg of light fastness improving agent ST-1, 9.0 kg of diisodecyl phthalate, and 18 L of ethyl acetate were mixed and dissolved at 50° C. While stirring, the resulting solution was added to and mixed with 75 L of an aqueous solution containing 3.5 kg of acid process gelatin, 1.5 kg of cationic polymer (P-19) and 6 L of a 50 percent aqueous saponin solution. The resulting mixture was subjected to emulsification dispersion, employing a high pressure homogenizer, manufactured by Sanwa Kogyo Co., Ltd., and then ethyl acetate was removed under reduced pressure. Subsequently, the total volume was adjusted to 100 L.

Light Fastness Improving Agent ST-1

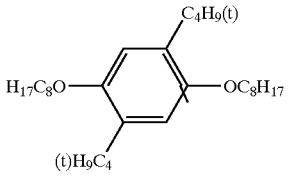

<<Preparation of Coating Compositions>>

First, second, third, and fourth layer coating compositions were prepared employing the methods described below.

(Preparation of the First Layer Coating Composition:

The following additives were successively added to 600 ml of Silica Dispersion 2, as prepared above, while stirring at 40° C.

| | |
|---|---|
| 10% Aqueous solution of polyvinyl alcohol (PVA 203, manufactured by Kuraray Kogyo Co., Ltd.) | 6 ml |
| 5% Aqueous solution of polyvinyl alcohol (a mixture of PVA 235 and PVA 245 at a ratio of 7/3), manufactured by Kuraray Kogyo Co., Ltd.) | 296 ml |
| Oil Dispersion 1 | 40 ml |
| Latex EmuLion · AE-803, manufactured by Daiichi Kogyo Co., Ltd. | 18 ml |
| Polyamine (Parafix EP, manufactured by Ohara Palladium Co.) | 20 ml |
| Pure water to make | 1000 ml |

(Preparation of the Second Layer Coating Composition)

Successively mixed with 640 ml of Silica Dispersion 2, prepared as above, were the following additives, while stirring at 40° C.

| | |
|---|---|
| 10% Aqueous solution of polyvinyl alcohol (PVA 203, manufactured by Kuraray Kogyo Co., Ltd.) | 6 ml |
| 5% Aqueous solution of polyvinyl alcohol (a mixture of PVA 235 and PVA 245 at a ratio of 7/3), manufactured by Kuraray Kogyo Co., Ltd.) | 240 ml |
| Oil Dispersion 1 | 55 ml |
| 20% Aqueous thioether based antioxidant (*1) solution | 30 ml |
| Pure water to make | 1000 ml |

*1: $HO—C_2H_4S—C_2H_4S—C_2H_4OH$ (Preparation of the Third Layer Coating Composition)

Successively mixed with 640 ml of Silica Dispersion 2, prepared as above, were the following additives, while stirring at 40° C.

| | |
|---|---|
| 10% Aqueous solution of polyvinyl alcohol (PVA 203, manufactured by Kuraray Kogyo Co., Ltd.) | 6 ml |
| 5% Aqueous solution of polyvinyl alcohol (a mixture of PVA 235 and PVA 245 at a ratio of 7/3), manufactured by Kuraray Kogyo Co., Ltd.) | 240 ml |
| Oil Dispersion 1 | 25 ml |
| Pure water to make | 1000 ml |

(Preparation of the Fourth Layer Coating Composition)

Successively mixed with 650 ml of Silica Dispersion 2, prepared as above, were the following additives, while stirring at 40° C.

| | |
|---|---|
| 10% Aqueous solution of polyvinyl alcohol (PVA 203, manufactured by Kuraray Kogyo Co., Ltd.) | 6 ml |
| 5% Aqueous solution of polyvinyl alcohol (a mixture of PVA 235 and PVA 245 at a ratio of 7/3), manufactured by Kuraray Kogyo Co., Ltd.) | 220 ml |
| 50% Aqueous saponin solution | 4 ml |
| Betaine Type Surface Active Agent 1 (5% aqueous solution) | 3 ml |
| Pure water to make | 1000 ml |

Betaine Type Surface Active Agent 1

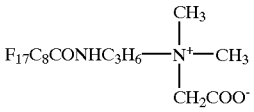

Each of said coating compositions prepared as above was filtered employing the filters described below.

First layer to third layer: 2 filtering stages employing TCP 10 manufactured by Toyo Roshi Co., Ltd.

Fourth layer: 2 filtering stages employing TCP 30 manufactured by Toyo Roshi Co., Ltd.

Onto the aforesaid support, coated on both sides with polyolefin, each layer was coated in the order of the first layer (50 μm), the second layer (50 μm), the third layer (50 μm), and the fourth layer (45 μm). Figures in parentheses show the wet thickness of each layer, and the first layer to the fourth the layer were simultaneously coated.

Each coating composition was subjected to slide type curtain coating at 40° C. Immediately after coating, the resulting coating was cooled in a 5° C. zone for 10 seconds, and was successively dried employing a 20 to 30° C. airflow for 30 seconds, a 70° C. airflow for 60 seconds, a 50° C. airflow for 60 seconds, and a 50° C. airflow for 30 seconds, whereby Recording Sheet 1 was prepared.

Said recording sheet contained 1.2 millimol of boron atoms per $m^2$.

(Preparation of Recording Sheets 2 through 19)

Recording Sheets 2 through 19 were prepared in the same manner as Recording Sheet 1, except that the layer surface pH of each recording sheet was varied and further, zirconium atom containing compounds were added as described in Table 1.

Incidentally, said zirconium containing compounds were provided employing either a method in which said compounds were added to the coating composition (and were subjected to in-line mixing with the coating composition just prior to coating) or a method in which said compound was subjected to overcoating (OC).

Further, the layer surface pH of the ink absorptive layer of each recording sheet was adjusted to the desired value by overcoating a 0.1 mol/L aqueous sodium hydroxide or nitric acid solution onto said recording sheet.

Incidentally, each of the zirconium compounds described in Table 1 are detailed hereunder.

ZR1: zirconyl acetate ZA, manufactured by Daiichi Kigenso Kagakukogyo Co., Ltd.

ZR2: zirconyl oxychloride, manufactured by Daiichi Kigenso Kagaku Kogyo Co., Ltd.

ZR3: zirconium sulfate

ZR4: zirconium acetylacetonatobisethylacetate (Print Evaluation)

Recording Sheets 1 through 19, prepared as above, were subjected to the evaluation described below, employing a desk-top type ink jet printer fitted with a piezo type head.

Incidentally, the pH of each ink employed for the evaluation is as follows:

yellow ink: 7.2, magenta ink: 7.8, cyan ink: 6.5, and black ink: 7.8.

The compositions of ink used for the evaluation are as follows. The figures in the table are weight parts.

TABLE 1

| | Zirconium Compound | | | Layer Surface pH | | | | | |
|---|---|---|---|---|---|---|---|---|---|
| Recording Sheet No. | Compound Name | Added Amount ($g/m^2$) | Addition Method | Before Printing | After Printing | Bleeding | Bronzing | Ambient Humidity Dependence | Remarks |
| 1 | – | – | – | 4.7 | 6.3 | 2.35 | none | 3.2 | Comparative Example |
| 2 | – | – | – | 3.7 | 5.1 | 2.21 | none | 2.8 | Comparative Example |
| 3 | ZR1 | 0.1 | added to coating composition | 4.6 | 6.3 | 1.45 | none | 13.8 | Comparative Example |
| 4 | ZR1 | 0.1 | added to coating composition | 4.0 | 5.7 | 1.43 | none | 7.1 | Present Invention |
| 5 | ZR1 | 0.1 | added to coating composition | 3.5 | 4.8 | 1.35 | none | 5.9 | Present Invention |
| 6 | ZR1 | 0.1 | added to coating composition | 2.8 | 3.6 | 1.11 | occurred | 2.2 | Comparative Example |
| 7 | ZR1 | 0.2 | added to coating composition | 4.5 | 6.3 | 1.21 | none | 17.2 | Comparative Example |
| 8 | ZR1 | 0.2 | added to coating composition | 4.0 | 5.8 | 1.18 | none | 9.3 | Present Invention |
| 9 | ZR1 | 0.2 | added to coating composition | 3.5 | 4.7 | 1.12 | none | 5.8 | Present Invention |
| 10 | ZR1 | 0.2 | added to coating composition | 2.6 | 3.4 | 1.07 | occurred | 2.0 | Comparative Example |
| 11 | ZR2 | 0.1 | added to coating composition | 4.6 | 6.2 | 1.48 | none | 12.8 | Comparative Example |
| 12 | ZR2 | 0.1 | added to coating composition | 4.1 | 5.6 | 1.52 | none | 6.6 | Present Invention |
| 13 | ZR2 | 0.1 | added to coating composition | 2.9 | 3.5 | 1.04 | occurred | 1.5 | Comparative Example |
| 14 | ZR3 | 0.1 | added to coating composition | 4.7 | 6.3 | 1.38 | none | 13.1 | Comparative Example |
| 15 | ZR3 | 0.1 | added to coating composition | 3.7 | 5.3 | 1.28 | none | 6.0 | Present Invention |
| 16 | ZR3 | 0.1 | added to coating composition | 3.0 | 3.7 | 1.05 | occurred | 1.3 | Comparative Example |
| 17 | ZR4 | 0.1 | OC | 5.0 | 6.4 | 1.67 | none | 10.2 | Comparative Example |
| 18 | ZR4 | 0.1 | OC | 4.0 | 5.6 | 1.60 | none | 4.7 | Present Invention |
| 19 | ZR4 | 0.1 | OC | 2.8 | 3.3 | 1.52 | occurred | 2.2 | Compatative Example |

| | Dye | DEG | Gly | TE GBE | Surfactant | Ion exchanged water |
|---|---|---|---|---|---|---|
| Yellow ink | C.I. Direct Yellow 132: 3.5 | 8 | 10 | 8 | 0.1 | 70 |
| Magenta ink | C.I. Acid Red 249: 3.5 | 8 | 10 | 8 | 0.1 | 70 |
| Cyan ink | C.I. Direct Blue 199: 3.5 | 8 | 10 | 8 | 0.1 | 70 |
| Black ink | C.I. Direct Black 168: 3.5 | 8 | 10 | 8 | 0.1 | 70 |

DEG: Diethylene glycol
Gly: Glycerin
TEGBE: Triethylene glycol monobutylether
Surfactant: Safinol 465 (Nissin Chemical Industry Co, Ltd)
The pH of each ink is adjusted to the above-mentioned value with 6% aqueous NaOH solution.

(Measurement of Layer Surface pH)

The layer surface pH of solid black image printed areas before and after printing was determined employing a flat electrode, manufactured by Toa Denpa Kogyo.

(Evaluation of Bleeding)

Fine black lines having a line width of 0.5 mm were printed on a background solid magenta image. The resulting print was stored at 40° C. and 80 percent relative humidity for one week, and subsequently, the line width was determined employing a microdensitometer. The increase ratio of said line width was determined as bleeding.

(Evaluation of Bronzing)

Solid yellow, magenta, cyan, and black image prints were stored at 23° C. and 80 percent relative humidity for two weeks, and the formation of bronzing on each print surface was visually evaluated.

(Evaluation of Ambient Humidity Dependence)

A neutral gray patch having a reflection density of about 1.0 was printed at two ambient conditions of 23° C. and 20 percent relative humidity, as well as 23° C. and 80 percent relative humidity. The color difference of the resulting prints was determined and said color difference was obtained at two ambient conditions.

$$\text{Color difference}=(\Delta a^2+\Delta b^2)^{1/2}$$

Table 1 shows each of the evaluation results obtained as above.

As can clearly be seen from Table 1, Recording Sheets 3 through 19 comprising zirconium atom containing compounds resulted in a marked decrease in bleeding, compared to Recording Sheets 1 and 2 comprising no zirconium atom containing compounds.

However, Recording Sheets 3, 7, 11, 14, and 17, comprising zirconium atom containing compounds and having a layer surface pH of at least 6 after printing, resulted in very large color variation due to ambient humidity variation during printing. Further, Recording Sheets 6, 10, 13, 16, and 19 resulted in bronzing.

On the other hand, it is clearly seen that Recording Sheets 4, 5, 8, 9, 12, 15, and 18 of the present invention, comprising zirconium atom containing compounds and having a layer surface pH of 4 to 6, did not result in bronzing and large color variation due to the ambient humidity variation, and resulted in a decrease in bleeding.

Example 2

Silica Dispersions 4 and 5, described below, were prepared in the same manner as Silica Dispersions 2 and 3 prepared in Example 1, except that the amount of boric acid based compounds was increased.

<<Preparation of Silica Dispersion 4>>

While stirring, 60.0 L of Silica Dispersion 1 were added to 15 L of an aqueous solution (at a pH of 2.3) comprising 2.12 kg of a cationic polymer (P-19), 2.2 L of ethanol, and 1.1 L of n-propanol. Subsequently, 8.0 L of an aqueous solution containing 320 g of boric acid and 190 g of borax were added to the resulting mixture, followed by the addition of 200 ml of an aqueous solution containing 2 g of antifoaming agent SN381, manufactured by Sun Nobco Co., Ltd.

The resulting mixture was dispersed employing a high pressure homogenizer, manufactured by Sanwa Kogyo Co., Ltd., and the total volume was then adjusted to 85 L, employing pure water, whereby Silica Dispersion 4 was prepared.

<<Preparation of Silica Dispersion 5>>

While stirring, 60.0 L of Silica Dispersion 1 were added to 15 L of an aqueous solution (at a pH of 2.3) comprising 2.12 kg of a cationic polymer (P-1), 4.2 L of ethanol, and 1.1 L of n-propanol. Subsequently, 8.0 L of an aqueous solution containing 32 g of boric acid and 190 g of borax were added to the resulting mixture, followed by the addition of 5 g of anionic optical brightening agent Uvitex NFW Liquid (manufactured by Ciba Specialty Chemical Co.).

The resulting mixture was dispersed employing a high pressure homogenizer, manufactured by Sanwa Kogyo Co., Ltd., and the total volume was then adjusted to 85 L, employing pure water, whereby Silica Dispersion 5 was prepared.

(Preparation of Recording Sheets 21 through 39)

Recording Sheets 21 through 39 were prepared in the same manner as Example 1, except that Silica Dispersion 2, employed in the first layer as well as the second layer, was replaced with Silica Dispersion 4; silica Dispersion 3, employed in the third layer as well as the fourth layer was replaced with Silica Dispersion 5; and further, the types and amount of zirconium atom containing compounds and the layer surface pH were varied as described in Table 2.

Each of the resulting recording sheets compriseed 10.4 millimol of boric atoms per $m^2$ of the ink absorptive layer.

(Evaluation of Recoding Sheets)

Each of the recording sheets, prepared as above, was subjected to evaluation of bleeding, bronzing, and ambient humidity dependence, employing the same methods as Example 1. Table 2 shows the obtained results.

TABLE 2

| Recording Sheet No. | Compound Name | Zirconium Compound Added Amount (g/m$^2$) | Zirconium Compound Addition Method | Layer Surface pH Before Printing | Layer Surface pH After Printing | Bleeding | Bronzing | Ambient Humidity Dependence | Remarks |
|---|---|---|---|---|---|---|---|---|---|
| 21 | – | – | – | 5.6 | 6.3 | 2.66 | none | 3.5 | Comparative Example |
| 22 | – | – | – | 4.4 | 5.2 | 2.54 | none | 3.4 | Comparative Example |
| 23 | ZR1 | 0.1 | added to coating composition | 5.6 | 6.3 | 1.50 | none | 12.2 | Comparative Example |
| 24 | ZR1 | 0.1 | added to coating composition | 5.0 | 5.6 | 1.45 | none | 6.2 | Present Invention |
| 25 | ZR1 | 0.1 | added to coating composition | 3.8 | 4.2 | 1.36 | none | 5.5 | Present Invention |
| 26 | ZR1 | 0.1 | added to coating composition | 2.9 | 3.2 | 1.14 | occurred | 1.5 | Comparative Example |
| 27 | ZR1 | 0.2 | added to coating composition | 5.7 | 6.3 | 1.13 | none | 16.1 | Comparative Example |
| 28 | ZR1 | 0.2 | added to coating composition | 5.3 | 5.7 | 1.14 | none | 8.8 | Present Invention |
| 29 | ZR1 | 0.2 | added to coating composition | 3.9 | 4.4 | 1.15 | none | 5.2 | Present Invention |
| 30 | ZR1 | 0.2 | added to coating composition | 3.2 | 3.5 | 1.10 | occurred | 1.4 | Comparative Example |
| 31 | ZR2 | 0.1 | added to coating composition | 5.6 | 6.2 | 1.52 | none | 11.2 | Comparative Example |
| 32 | ZR2 | 0.1 | added to coating composition | 4.6 | 5.1 | 1.55 | none | 5.6 | Present Invention |
| 33 | ZR2 | 0.1 | added to coating composition | 3.3 | 3.7 | 1.11 | occurred | 1.2 | Comparative Example |
| 34 | ZR3 | 0.1 | added to coating composition | 5.8 | 6.3 | 1.44 | none | 13.0 | Comparative Example |
| 35 | ZR3 | 0.1 | added to coating composition | 4.8 | 5.4 | 1.31 | none | 6.2 | Present Invention |
| 36 | ZR3 | 0.1 | added to coating composition | 3.2 | 3.6 | 1.11 | occurred | 1.3 | Comparative Example |
| 37 | ZR4 | 0.1 | OC | 5.7 | 6.4 | 1.72 | none | 10.0 | Comparative Example |
| 38 | ZR4 | 0.1 | OC | 4.7 | 5.2 | 1.65 | none | 4.2 | Present Invention |
| 39 | ZR4 | 0.1 | OC | 3.0 | 3.5 | 1.61 | occurred | 2.1 | ComparativeExample |

As can clearly be seen from Table 2, Recording Sheets 24, 25, 28, 29, 32, 35, and 38 of the present invention, comprising zirconium atom containing compounds and having a layer surface pH of 4 to 6, did not result in bronzing and large color variation due to the ambient humidity variation, and resulted in a decrease in bleeding, in the same manner as the results of Example 1.

Further, when the results obtained in Example 1 were compared to those obtained in Example 2, it was confirmed that by incorporating a relatively large amount of boric acid chloride as the buffer, it was possible to minimize the increase in the layer surface pH after printing, and by adjusting the layer surface pH from 3.5 to 5.5 prior to printing, it was possible to regulate the layer surface pH after printing from 5 to 6.

Example 3

Recording Sheets 22A through 22C, and 25A through 25C were prepared in the same manner as Recording Sheets 22 through 25 prepared in Example 2, except that silica dispersions of the first layer through fourth layer were varied as shown in Table 3, and were subjected to evaluation of bleeding, bronzing, and ambient humidity dependence, employing the same methods as Example 1. Table 3 shows the obtained results.

TABLE 3

| Recording Sheet No. | Silica Dispersion No. First layer | Second layer | Third layer | Fourth layer | Zirconium Compound | Layer Surface pH Before Printing | After Printing | Bleeding | Bronzing | Ambient Humidity Dependence | Remarks |
|---|---|---|---|---|---|---|---|---|---|---|---|
| 22 | 4 | 4 | 5 | 5 | – | 4.4 | 5.2 | 2.66 | none | 3.5 | Comparative Example |
| 22A | 4 | 4 | 4 | 4 | – | 4.5 | 5.2 | 3.52 | none | 6.4 | Comparative Example |
| 22B | 5 | 5 | 5 | 5 | – | 4.3 | 5.1 | 2.12 | none | 4.2 | Comparative Example |
| 22C | 5 | 5 | 4 | 4 | – | 4.4 | 5.2 | 2.81 | none | 7.2 | Comparative Example |
| 25 | 4 | 4 | 5 | 5 | ZR1 | 3.8 | 4.2 | 1.36 | none | 5.5 | Present Invention |

TABLE 3-continued

| Recording Sheet No. | Silica Dispersion No. First layer | Second layer | Third layer | Fourth layer | Zirconium Compound | Layer Surface pH Before Printing | After Printing | Bleeding | Bronzing | Ambient Humidity Dependence | Remarks |
|---|---|---|---|---|---|---|---|---|---|---|---|
| 25A | 4 | 4 | 4 | 4 | ZR1 | 3.9 | 4.3 | 1.61 | none | 7.4 | Present Invention |
| 25B | 5 | 5 | 5 | 5 | ZR1 | 3.8 | 4.2 | 1.23 | none | 6.8 | Present Invention |
| 25C | 5 | 5 | 4 | 4 | ZR1 | 3.8 | 4.2 | 1.40 | none | 8.8 | Present Invention |

As can clearly be seen from Table 3, even though the cationic polymer in the recording sheets was varied, by incorporating zirconium atom containing compounds and adjusting the layer surface pH of solid image printed areas to 6 or less after printing, bronzing as well as color variation due to ambient humidity variation was minimized, and at the same time, bleeding is also minimized.

Specifically, Recording Sheets 25, 25B, and 25C, employing Silica Dispersion 5 comprising the cationic polymer (P-1) having the repeated units represented by General Formula (1), resulted in a marked decrease in bleeding. Further, it is seen that Recording Sheets 25 and 25B, in which Silica Dispersion 5 was employed in the uppermost layer (being the fourth layer) resulted in a marked decrease in color variation. The most preferred recoding sheet is Recording Sheet 25 in which Silica Dispersion 5 is employed in the uppermost layer and the cationic polymer other than those represented by General Formula (1) is employed in the lower layer.

Example 4

Recording Sheets 41 through 49 were prepared in the same manner as Recording Sheet 3 prepared in Example 1, except that each of the acids described in Table 4 was added to the first layer. A methanol solution was prepared employing each of said employed acids. Each of said recording sheets was prepared by overcoating the resulting solution onto Recording Sheet 3 and subsequently drying the resulting coating at 70 to 80° C. and said sheets were subjected to evaluation of bleeding, bronzing, and ambient humidity dependence, employing the same method as Example 1. Table 4 shows the obtained results.

TABLE 4

| Recording Sheet No. | Organic Acid | Layer Surface pH Before Printing | After Priting | Bleeding | Bronzing | Ambient Humidity Dependence | Remarks |
|---|---|---|---|---|---|---|---|
| 3 | – | 4.6 | 6.3 | 1.45 | none | 13.5 | Comparative Example |
| 41 | benzoic acid | 4.6 | 5.7 | 1.52 | none | 8.3 | Present Invention |
| 42 | benzoic acid | 4.1 | 5.0 | 1.55 | none | 6.2 | Present Invention |
| 43 | benzoic acid | 3.5 | 4.2 | 1.50 | none | 4.2 | Present Invention |
| 44 | benzoic acid | 3.1 | 3.5 | 1.22 | occurred | 2.3 | Compatative Example |
| 45 | ascorbic acid | 4.3 | 5.3 | 1.61 | none | 6.9 | Present Invention |
| 46 | citric acid | 4.8 | 5.2 | 1.63 | none | 6.0 | Present Invention |
| 47 | citric acid | 4.3 | 4.6 | 1.41 | none | 5.1 | Present Invention |
| 48 | citric acid | 3.8 | 4.1 | 1.33 | none | 4.7 | Present Invention |
| 49 | citric acid | 3.5 | 3.7 | 1.25 | occurred | 3.5 | Comparative Example |

As can clearly be seen from Table 4, Recording Sheets 41, 42, 43, 45, 47, and 48, in which the layer surface pH of the ink absorptive layer after printing was adjusted to the range of 4 to 6 by incorporating organic acids in said ink absorptive layer, resulted in no bronzing, and in a decrease in bleeding, while minimizing the effects of ambient humidity.

Example 5

Recording Sheets 51 through 59 were prepared in the same manner as Example 2, except that zirconium atom containing compounds were replaced with aluminum atom containing compounds described in Table 5. Incidentally, in Table 5, AL1 represents basic aluminum chloride, and AL2 represents aluminum sulfate.

Recording Sheets 51 through 59 as well as Recording Sheets 21 and 22 were subjected to evaluation of bleeding, bronzing and ambient humidity dependence, employing the same method as Example 1. Table 5 shows the obtained results.

TABLE 5

| | Aluminum Compound | | | Layer Surface pH | | | | ambient | |
|---|---|---|---|---|---|---|---|---|---|
| | | Added | | | | | | | |
| Recording Sheet No. | Compound Name | Amount ($g/m^2$) | Addition Method | Before Printing | After Printing | Bleeding | Bronzing | Humidity Dependence | Remarks |
| 21 | – | – | – | 5.6 | 6.3 | 2.66 | none | 3.5 | Comparative Example |
| 22 | – | – | – | 4.4 | 5.2 | 2.54 | none | 3.4 | Comparative Example |
| 51 | AL1 | 0.1 | added to coating composition | 5.7 | 6.5 | 1.38 | none | 9.8 | Comparative Example |
| 52 | AL1 | 0.1 | added to coating composition | 5.0 | 5.7 | 1.35 | none | 4.2 | Present Invention |
| 53 | AL1 | 0.1 | added to coating composition | 4.3 | 4.8 | 1.30 | none | 4.3 | Present Invention |
| 54 | AL1 | 0.1 | added to coating composition | 3.6 | 4.3 | 1.27 | none | 3.8 | Present Invention |
| 55 | AL1 | | added to coating composition | 3.1 | 3.8 | 1.11 | occurred | 2.2 | Comparative Example |
| 56 | AL2 | 0.1 | OC | 5.5 | 6.5 | 1.42 | none | 10.3 | Comparative Example |
| 57 | AL2 | 0.1 | OC | 4.6 | 5.2 | 1.40 | none | 5.7 | Present Invention |
| 58 | AL2 | 0.1 | OC | 3.7 | 4.5 | 1.37 | none | 4.3 | Present Invention |
| 59 | AL2 | 0.1 | OC | 3.0 | 3.6 | 1.14 | occurred | 2.5 | Comparative Example |

As can clearly be seen from Table 5, it was confirmed that even when said aluminum compounds were employed, by adjusting the layer surface pH after printing from 4 to 6, it was possible to minimize bleeding while minimizing bronzing as well as to minimize color variation due to variations of ambient humidity.

The present invention makes it possible to provide an ink jet recording sheet which, during storage after printing, results in minimized bleeding and improved water resistance of prints, prepared by employing water-soluble dyes without enhancing bronzing, and results in minimized variation of color reproduction with respect to ambient humidity variation.

What is claimed is:

1. An ink jet recording sheet comprising a non-water absorptive support having thereon an ink absorptive layer comprising:

(i) polyvinyl alcohol;

(ii) a cationic polymer; and (iii) a compound selected from the group consisting of aluminum hydroxy chloride, basic aluminum sulfate, basic aluminum sulfate silicate, zirconyl carbonate, ammonium zirconyl carbonate, zirconyl nitrate, zirconium, zirconyl chloride, oxychloride, zirconium lactate, and zirconyl citrate;

wherein a surface pH of said ink absorptive layer is 4 to 6 measured 30 minutes after receiving a water based ink of pH range 6 to 9 jetted from an ink jet printer in an amount of 20 $ml/m^2$.

2. The ink jet recording sheet of claim 1, wherein an average molecular weight of the cationic polymer is between 5,000 and 100,000.

3. The ink jet recording sheet of claim 1, wherein the surface pH of said ink absorptive layer is 4.5 to 5.5 measured 30 minutes after receiving a water based ink of pH range 6 to 9 jetted from an ink jet printer in an amount of 20 $ml/m^2$.

4. The ink jet recording sheet of claim 1, wherein the ink absorptive layer is a porous layer.

5. The ink jet recording sheet of claim 1, wherein said ink absorptive layer comprises boric acid or a salt thereof in an amount of 2 to 30 millimol per $m^2$ of said ink absorptive layer, and a surface pH of said ink absorptive layer prior to receiving ink is from 3.5 to 5.5.

6. The ink jet recording sheet of claim 1, wherein said cationic polymer is represented by Formula (1), Formula (1)

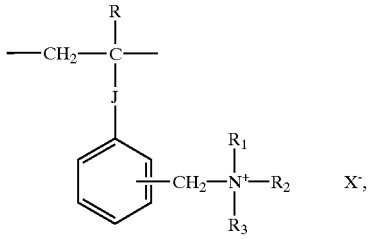

wherein R represents a hydrogen atom or an alkyl group; $R_1$, $R_2$, and $R_3$ each represent an alkyl group or a benzyl group; J represents a bond or a divalent organic group; $X^-$ represents an anion group.

7. The ink jet recording sheet of claim 1, wherein said ink absorptive layer comprises at least two ink absorptive layers, wherein said cationic polymer in said ink absorptive layer farthest from said non-water absorptive support comprises a repeating unit represented by Formula (1), Formula (1)

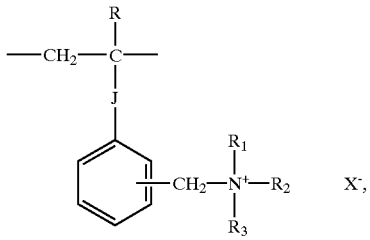

wherein R represents a hydrogen atom or an alkyl group; $R_1$, $R_2$, and $R_3$ each represent an alkyl group or a benzyl group; J represents a bond or a divalent organic group; $X^-$ represents an anion group.

8. The ink jet recording sheet of claim 1, wherein the ink absorptive layer comprises the compound in an amount of 0.1 to 5 $g/m^2$.

* * * * *